US007823864B2

(12) United States Patent
Xie et al.

(10) Patent No.: US 7,823,864 B2
(45) Date of Patent: Nov. 2, 2010

(54) PLANE BRAKING DEVICE FOR ELECTRIC WINCHES AND ELECTRIC WINCH

(76) Inventors: Yuzhi Xie, Room 1706, No. 18, Junzi Street, Haishu Area, Ningbo, Zhejiang (CN) 315000; Kuo-hsiang Tsao, Floor 3, No. 127, Kangle Street, Neihu Area, Taibei, Taiwan (CN) 11487

( * ) Notice: Subject to any disclaimer, the term of this patent is extended or adjusted under 35 U.S.C. 154(b) by 37 days.

(21) Appl. No.: 12/377,696

(22) PCT Filed: Aug. 13, 2007

(86) PCT No.: PCT/CN2007/002422

§ 371 (c)(1),
(2), (4) Date: Feb. 17, 2009

(87) PCT Pub. No.: WO2008/022544

PCT Pub. Date: Feb. 28, 2008

(65) Prior Publication Data

US 2010/0127228 A1 May 27, 2010

(30) Foreign Application Priority Data

Aug. 17, 2006 (CN) ..... 2006 2 0106775 U
Apr. 18, 2007 (CN) ..... 2007 2 0108282 U

(51) Int. Cl.
*B66D 1/14* (2006.01)

(52) U.S. Cl. ..... 254/347; 254/344; 254/351; 254/350; 254/366; 254/368

(58) Field of Classification Search ..... 254/342, 254/344, 346, 347, 350, 351, 366, 368
See application file for complete search history.

(56) References Cited

U.S. PATENT DOCUMENTS 3,744,760 A * 7/1973 Uher ..... 254/351

(Continued)

FOREIGN PATENT DOCUMENTS

CN 2868972 2/2007

*Primary Examiner*—Emmanuel M Marcelo
(74) *Attorney, Agent, or Firm*—Dickinson Wright PLLC

(57) ABSTRACT

The present invention discloses a plane braking device for electric winches and electric winch which disposes a section of hollow gear shaft, a section of core shaft, a fixing ring, a wedge shape support, a stopping piece, a braking plate, an elastic element, a wedge shape piece B, a wedge shape piece A, a braking clutch base and so on in a gear box of an electric winch. When a motor works, the section of core shaft of the motor drives the braking clutch base and the wedge shape pieces A, B to rotate, until a gap is formed between the adjacent braking plate and stopping piece between the braking clutch base and the wedge shape piece B, so that the braking effect disappears. When the motor stops suddenly, a heavy load lifted by a tight wire drum provides a reverse pulling force so that the wedge shape piece B produces a reverse thrust force to push the friction planes of the braking plate and the stopping piece, so the plane braking effect is achieved quickly. Based on the plane braking plate, the present invention can increase the braking area and the braking force and achieve safe braking. Furthermore, when there is wear of parts in long usage, so it only needs to replace the braking plate made of friction materials, which can simplify maintenance, reduce the parts costs and ensure service life of the gear box.

8 Claims, 10 Drawing Sheets

U.S. PATENT DOCUMENTS 4,004,780 A * 1/1977 Kuzarov ..... 254/345
4,123,040 A * 10/1978 Kuzarov ..... 254/342
4,461,460 A * 7/1984 Telford ..... 254/344
4,545,567 A * 10/1985 Telford et al. ..... 254/344
5,002,259 A * 3/1991 Manning et al. ..... 254/350
5,123,630 A * 6/1992 Watson et al. ..... 254/346
5,398,923 A * 3/1995 Perry et al. ..... 254/375
5,860,635 A * 1/1999 Morfitt et al. ..... 254/377
7,703,751 B2 * 4/2010 Elliott et al. ..... 254/344
2005/0242333 A1 * 11/2005 Peterson ..... 254/368

* cited by examiner

PLANE BRAKING DEVICE FOR ELECTRIC WINCHES AND ELECTRIC WINCH

BACKGROUND OF THE INVENTION

1. Field of the Invention

The present invention relates to a braking device and electric winch, and more particularly to a plane braking device for electric winches and electric winch.

2. Description of the Prior Art

Electric brakes pull goods via reeling tight wire rope for self-aid and buddy aid in automobile accidents in the fields. For avoiding stall of tight wire rope caused by sudden power cut during retracting, braking devices are disposed for ensuring safe operation. A braking device for power winches disclosed in Chinese Patent Publish No. CN2484297Y includes a gear box, a braking cover, a section of gear shaft, a section of core shaft extending from a motor shaft, a wedge shape piece A, a wedge shape piece B, a braking clutch base, an elastic element, a brake plate and so on. The braking device uses the section of core shaft extending from the motor shaft to drive the braking clutch base to rotate. Inner double flanges in the braking clutch base simultaneously drive the wedge shape piece A and the wedge shape piece B to rotate. At this time, the braking plate on the wedge shape piece B and a friction tapered face of the gear box still keep a gap therebetween, so the braking device is in a non-braking state. When the motor suddenly stops, the inertia of the braking clutch base causes that the wedge shape piece B moves axially while rotating to drive the braking plate to achieve the single tapered face braking for the gear box. However, the braking device has the shortcomings that the braking area and the braking force produced by the single tapered face braking is small, slipping phenomena are easy to occur, and the braking plate directly acts on the tapered face of the gear box, which will easily make the tapered face to be wearing directly, so that the tapered face lose braking efficacy and the gear box must be replaced, which causes that the difficult maintenance and high replacement cost of parts.

This kind of present electric winch usually includes left and right support racks, a drum, a rotating shaft, a connecting shaft, a braking device disposed on the connecting shaft, a clutch device disposed on the rotating shaft and so on. A motor transfers power to the connecting shaft and the rotating shaft and drives the drum to rotate backward or forward via shaft teeth and planetary gears which engage with each other on the rotating shaft. The clutch device can control the motor shaft to transfer power to the drum. The braking device controls the connecting shaft to stop or rotate, thereby improving operation security and usage convenience. The present electric winch can have not only an effect of rapid clutch but also an effect of rapid braking, which is convenient for use. However, the electric winch still has a lot of structure shortcomings, for example, the braking device has structure performance not good enough and generally achieves a braking effect based on hard friction between metals, which causes that the parts are easy to be worn, so the braking device has a short service life and bad stability and operation security; and the parts of the clutch device have a complicated manufacturing process, which increases the manufacture costs.

SUMMARY OF THE INVENTION

An object of the present invention is to provide a plane braking device for electric winches and electric winch, wherein the plane braking device has a large braking area, good braking effects and low replacement cost of parts and avoids wearing the gear box directly, and the electric winch has the advantages of good structure performance, stable working performance, good operation security, simple manufacturing process, low manufacture costs and a long service life.

To achieve the above-mentioned object, a plane braking device for an electric winch and electric winch in accordance with the present invention is disclosed.

A plane braking device for electric winches includes: a gear box fixed on an electric winch; a braking cover fixedly connected with the gear box; a section of hollow gear shaft inserted in a shaft hole of the gear box and supported by a bearing; a section of core shaft extending from a motor shaft and passing through the hollow gear shaft, wherein one extended end portion of the core shaft which extends out of the hollow gear shaft is a polyhedron; a wedge shape piece A setting the hollow gear shaft and engaging with the hollow gear shaft, wherein a left end face of the wedge shape piece A is a cam face formed by double tapered faces, a right end face of the wedge shape piece A is limited axially by a C-ring, and an outer double flange structure is arranged with homogeneous distribution on the outer surface along an outer circumference face of the wedge shape piece A; a wedge shape piece B setting on the hollow gear shaft, wherein a right end face of the wedge shape piece B is a cam face formed by double tapered faces which engage with the wedge shape piece A, an outer double flange structure is arranged with homogeneous distribution on the outer surface along an outer circumference face of the wedge shape piece B; a plurality of braking plates; an elastic element bushing on the section of hollow gear shaft and abutting against the wedge shape piece B; a braking clutch base which has a center setting the end portion of the section of core shaft and combined with the polyhedron of the end portion, wherein a bearing supports between the braking clutch base and the braking cover, and an inner double flange structure is formed on an inner circumference face of the braking clutch base, matching to the outer double flange structures of the wedge shape piece A and the wedge shape piece B, to push the outer double flange structure of the wedge shape piece A to rotate thereby pushing the wedge shape piece B to move axially; a fixing ring closely disposed on an inner shoulder of the gear box; a wedge shape support setting on the section of hollow gear shaft; and a plurality of stopping pieces which is disposed between the wedge shape support and the wedge shape piece B and setting on the section of hollow gear shaft and engaged and drive-connected with the section of hollow gear shaft, the braking plates limited radially to rotate by a plurality of fixing ring and the elastic element are disposed between the stopping piece and the wedge shape piece B.

A plurality of extending sections axially extends from one end face of the fixing ring to form open slots arranged with homogeneous distribution on the outer surface along a circumference of the fixing ring, and the braking plates has keys arranged with homogeneous distribution on the outer surface on a circumference thereof and movably inserted in the open slots of the fixing ring.

The number of braking plates arranged axially is 4-6.

The wedge shape piece B has a ring groove formed in a left end face thereof for receiving the elastic element.

Comparing with the prior art, the present invention uses the friction braking of the multi-planes to replace the friction braking of the single tapered face, and there is no friction braking existing between the braking plates and the gear box. The optimal material selection for the wedge shape support, the stopping pieces and the wedge shape piece B can ensure that the friction wear faces concentrate in the braking plates and the braking area increases greatly, so the braking force increases and the braking is safer. Additionally, when the braking wear is serious, it only needs to replace the braking plates made of friction materials, which can simplify maintenance and reduce the costs greatly.

An electric winch includes left and right support racks; a drum disposed between the support racks and having two ends supported by bushings; a connecting shaft disposed in the drum and driven to rotate by a motor; a rotating shaft drive-connected with the connecting shaft and having a plurality of shaft teeth each of which engages with a corresponding planetary gear and drives the drum to rotate in clockwise and anticlockwise direction based on the rotation of the planetary gear inside the gear; a braking device which is disposed on the connecting shaft, a clutch device is disposed on the rotating shaft, wherein a. The braking device includes a braking base which drive-connected with a motor shaft, wherein a wedge shape piece A and a wedge shape piece B are assembled in the braking base based on cam faces and driven to rotate by the braking base, internal teeth of the wedge shape piece A engage with external teeth of the connecting shaft, and on one adjacent side of the wedge shape piece B, a braking plate and a stopping piece, which are pushed to brake by a spiral spring, and the spiral spring is disposed between the wedge block B and the braking plate on the connecting shaft;

b. and the clutch device which includes a clutch base fixed on the support racks, wherein a bottom of the clutch base is a rising and falling protruding face which has blocking points disposed thereon; a clutch handle is disposed on the clutch base, and integral inserting feet extend from an end face of the handle; a rotation base is disposed in the clutch base and driven to rotate by the integral inserting feet of the handle; two symmetrical protruding blocks are disposed on an outer circumference face of the rotation base and pushed by the convex face of the clutch base and limited by the blocking points, and a C-ring II and a copper washer are disposed between the adjacent shaft teeth on the rotating shaft and fastened on the rotating shaft.

The plurality of shaft gear are third section shaft gear, second section shaft gear and first section shaft gear which drive-connected with the rotating shaft, which are setting on the rotating shaft, the corresponding first section shaft gear engage with first section planetary gears, the second section shaft gear engage with second section planetary gears, and the third section shaft gear engage with third section planetary gears; first grade transmission pieces are disposed between the first section planetary gears and the second section shaft gear, and second grade transmission pieces are disposed between the second section planetary gears and the third section shaft gear; and the third section planetary gears are disposed on the drum.

An axle bushing is disposed on the integral gear shafts of the drum, between the third section planetary gears and the drum.

A friction block is disposed between a bottom of the rotation base and an end portion of the rotating shaft.

Comparing with the prior art, the present invention uses the braking device and the clutch device with improved structures, wherein the clutch device uses the flexible braking plate and stopping piece and pushes the braking plate and the stopping piece to cling to each other based on the relative rotation of the wedge shape piece A and the wedge shape piece B of which the cam faces are engaged to each other, to achieve the braking effect, so the braking device can reduce wear of parts caused by hard friction, extend its service life; furthermore, besides ensuring good work stability and operation security of the clutch, the present invention only needs to turn the handle to push the rotating base and the rotating shaft to move axially so that the shaft teeth are detached from the planetary gears to achieve the clutch, which simplifies the manufacturing process and reduces manufacture costs effectively to meet the market requirements.

DETAILED DESCRIPTION OF THE INVENTION

Figure 1:
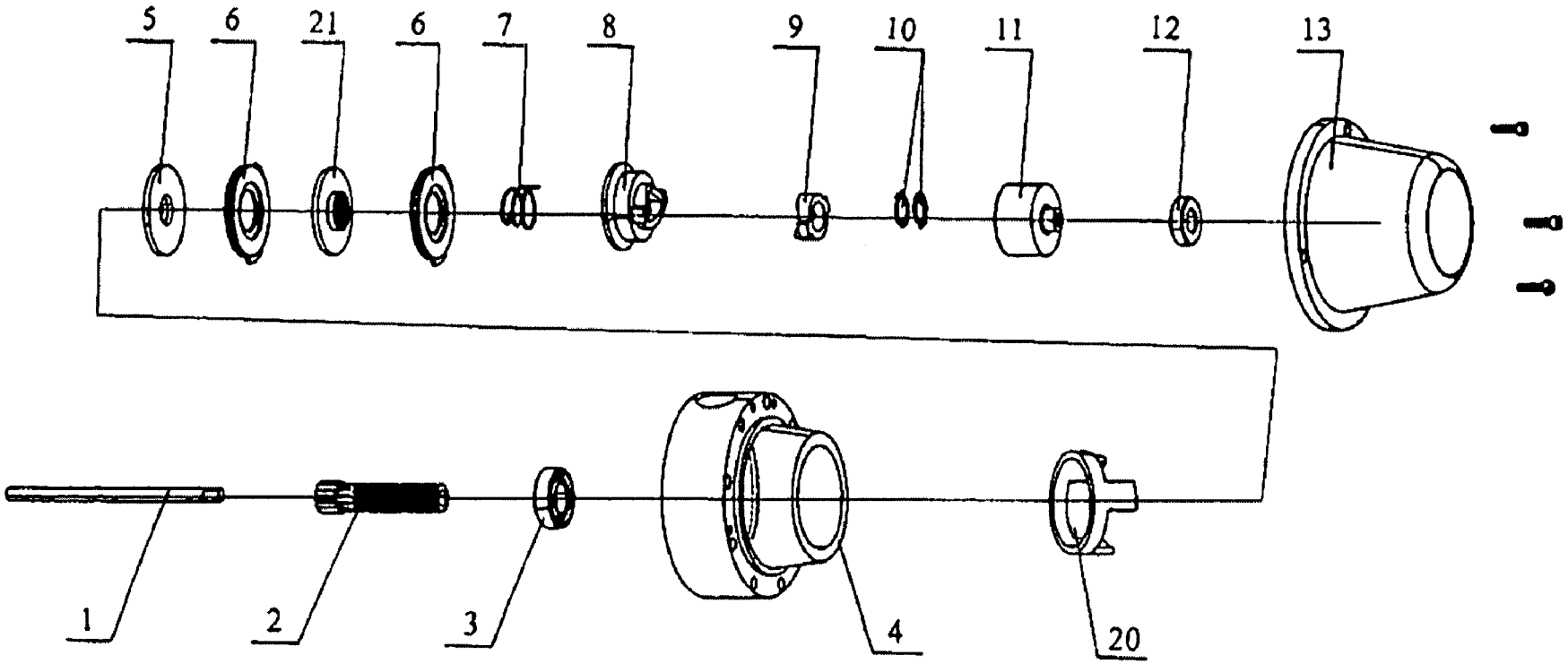
FIG. 1 is an exploded perspective view of a plane braking device for electric winches according to the present invention.

The following is the detailed description of the embodiment of the present invention in connection with the appended drawings.

As shown in FIGS. 1-9, a plane braking device for electric winches according to the present invention includes a gear box 4 fixed on an electric winch, a braking cover 13 fixedly connected with the gear box 4, and a section of hollow gear shaft 2 which extends into the center of the gear box 4 and is supported by a bearing 3. The hollow gear shaft 2 has a multikey structure. A section of core shaft 1 extending from a motor shaft passes through the hollow gear shaft 2, and one extended end portion of the core shaft 1 which extends out of the hollow gear shaft 2 is a hexahedron 18. Besides the bearing 3, a fixing ring 20, a wedge shape support 5, a braking plate 6, a stopping piece 21, an elastic element 7, a wedge shape piece B 8 and a wedge shape piece A 9 are respectively disposed on the section of hollow gear shaft 2 from left to right.

The fixing ring 20 is closely disposed on the inner shoulder of the gear box 4. Three extending sections, which are arranged with homogeneous distribution on the outer surface along the circumference of the fixing ring 20, axially extend from one end face of the fixing ring 20, thereby forming three open slots along the circumference in the fixing ring.

The wedge shape support 5 surrounds the section of hollow gear shaft 2 with gap thereof and the wedge shape support 5 is made of the wear resistant alloy steel.

The stopping piece 21 has an inner hole with a multikey structure. The stopping piece 21 sets on the second of hollow gear shaft 2 and engages with the second of hollow gear shaft 2 to establish a transmission relationship. The embodiment has one stopping piece, so it has two braking plates. Friction materials adhere to two sides of each metal piece which is used for manufacturing the braking plate, and are respectively disposed between the wedge shape support 5 and the stopping piece 21 and between the stopping piece 21 and the wedge shape piece B 8, thereby forming four contacting friction surfaces. So the friction area increases, which further causes that a braking force increases. The number of the braking plate 6 can be increased or reduced according to power requirements. Each braking plate 6 has three keys arranged with homogeneous distribution on the outer surface on the circumference surface thereof. The keys can be movably inserted in the open slots of the fixing ring 20 so that the braking plates 6 are limited in the radial direction by the fixing ring 20 and can only rotate in a small space.

Figure 3:
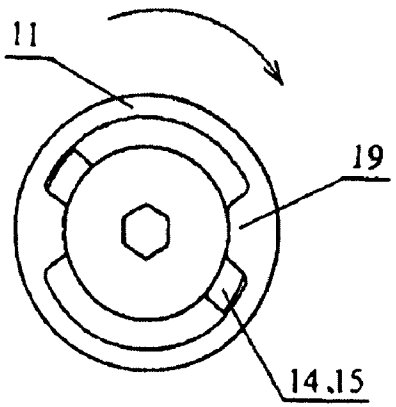
FIG. 3 is a schematic view showing relative positions of a braking clutch base and wedge shape pieces A, B when the present invention is in the clockwise rotation and non-braking state.
Figure 2:
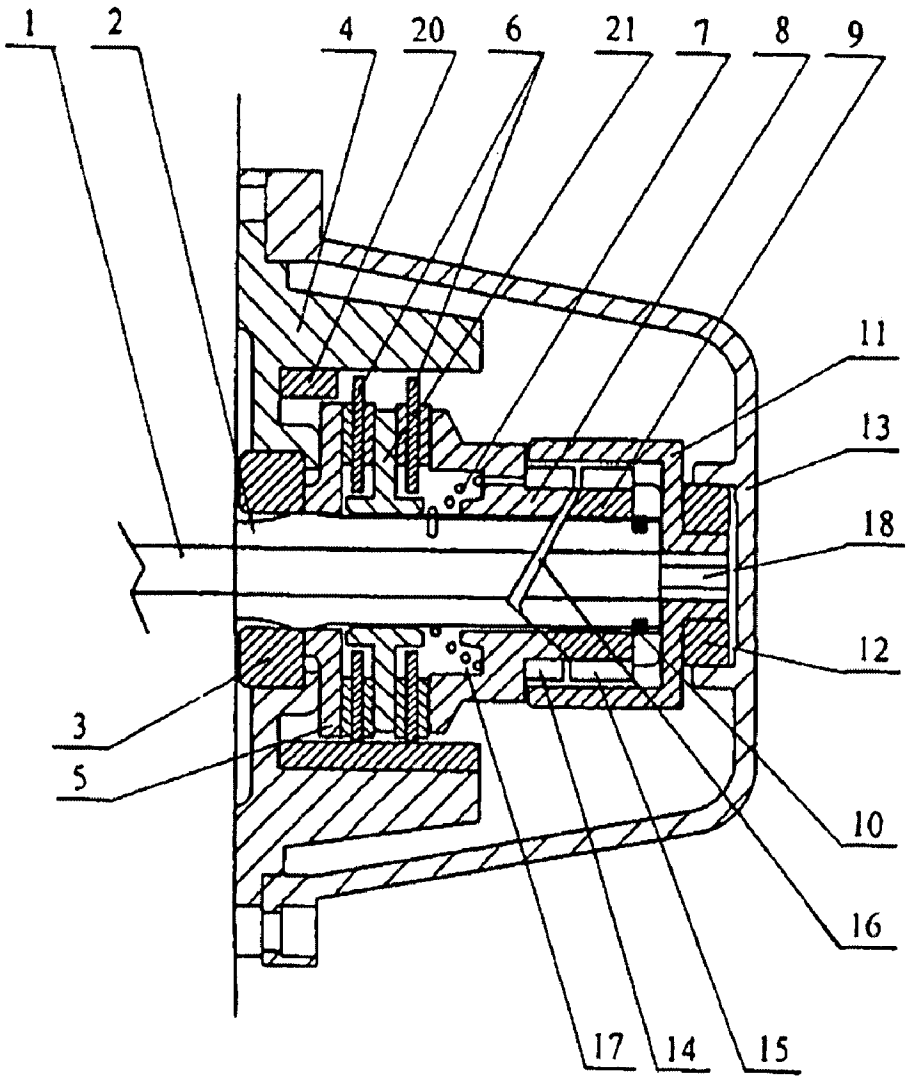
FIG. 2 is a structural view of the present invention, in a clockwise rotation and non-braking state.
Figure 4:
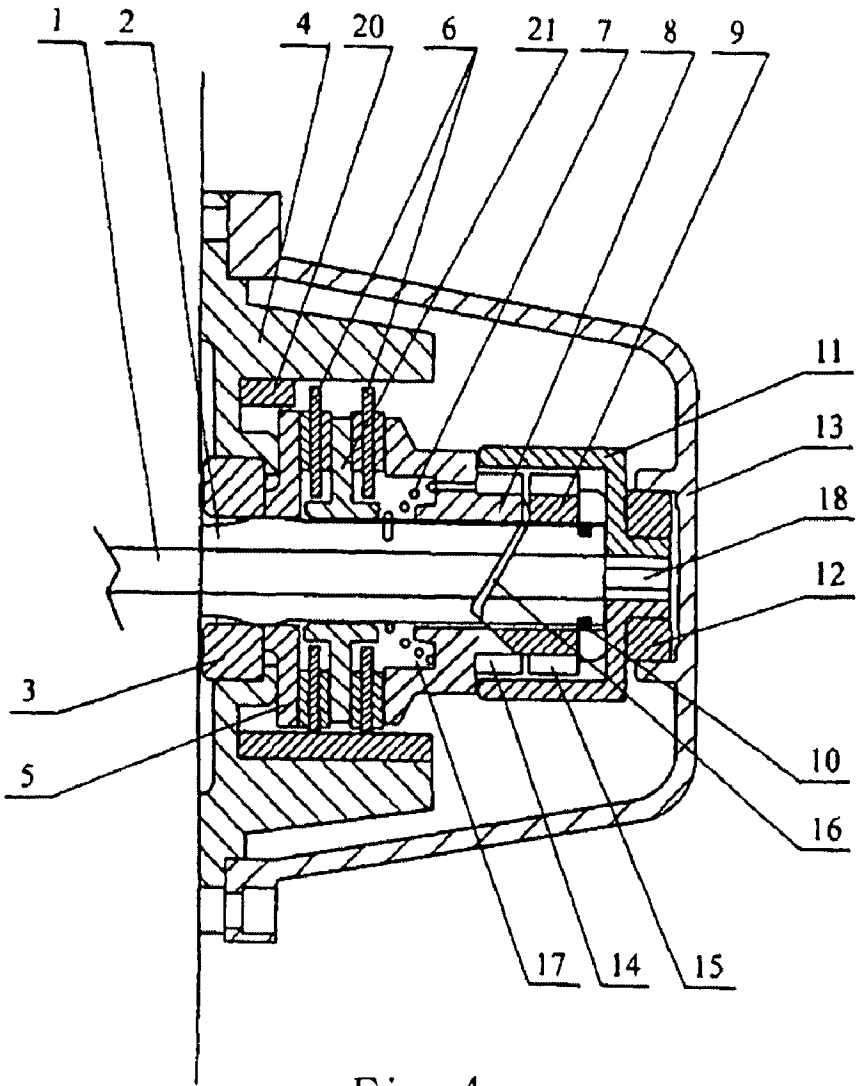
FIG. 4 is a structural view of the present invention, in an anticlockwise rotation and non-braking state.

The elastic element 7 is a pagoda-shaped left-hand spring and disposed between the stopping piece 21 and the wedge shape piece B 8 which are made of wear resistant alloy steel, one end fastened in a hole of the section of hollow gear shaft 2 and the other end fastened in a hole of a ring groove 17 of the wedge shape piece B 8. The elastic element 7 is convenient for pushing the wedge shape piece B when there is no need of braking, thereby relieving the thrust acting on the braking plates 6 and forming gaps between the braking plate and the stopping piece and between the braking plate and the wedge shape support (as shown in FIGS. 2-4). During assembly, the elastic element 7 is compressed, so there is a tendency to push the wedge shape piece B away so that the friction faces of the braking plates provide a gap. Accordingly, during assembly, it needs a proper turning force existing between the wedge shape piece B 8 and the elastic element 7, that is, when the two ends of the elastic element 7 are respectively fastened in the holes, the wedge shape piece B 8 needs to have a proper reverse turning force relative to the elastic element 7.

Figure 7:
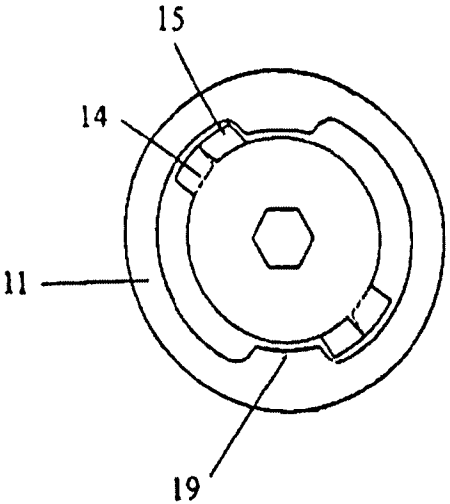
FIG. 7 is a schematic view showing relative positions of the braking clutch base and the wedge shape pieces A, B when the present invention is in a clockwise rotation and braking state.
Figure 8:
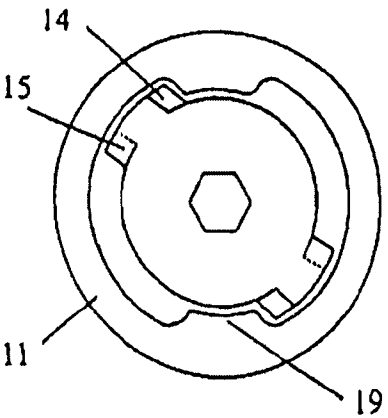
FIG. 8 is a schematic view showing relative positions of the braking clutch base and the wedge shape pieces A, B when the present invention is in an anticlockwise rotation and braking state.
Figure 6:
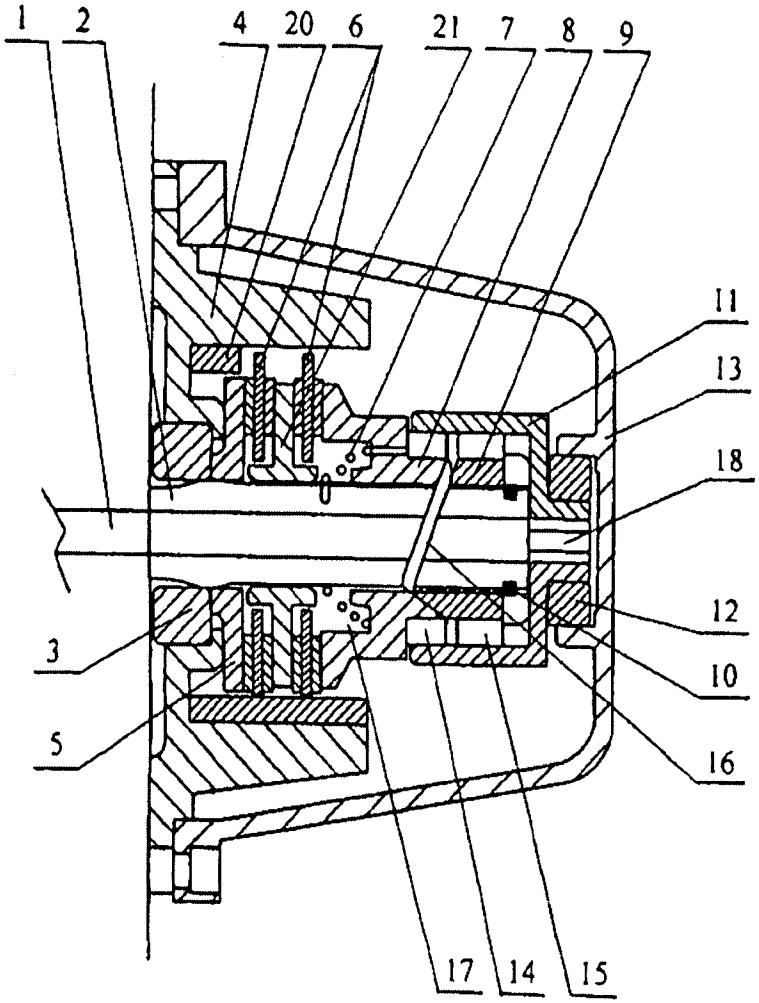
FIG. 6 is a structural view of the present invention, in a braking state.
Figure 9:
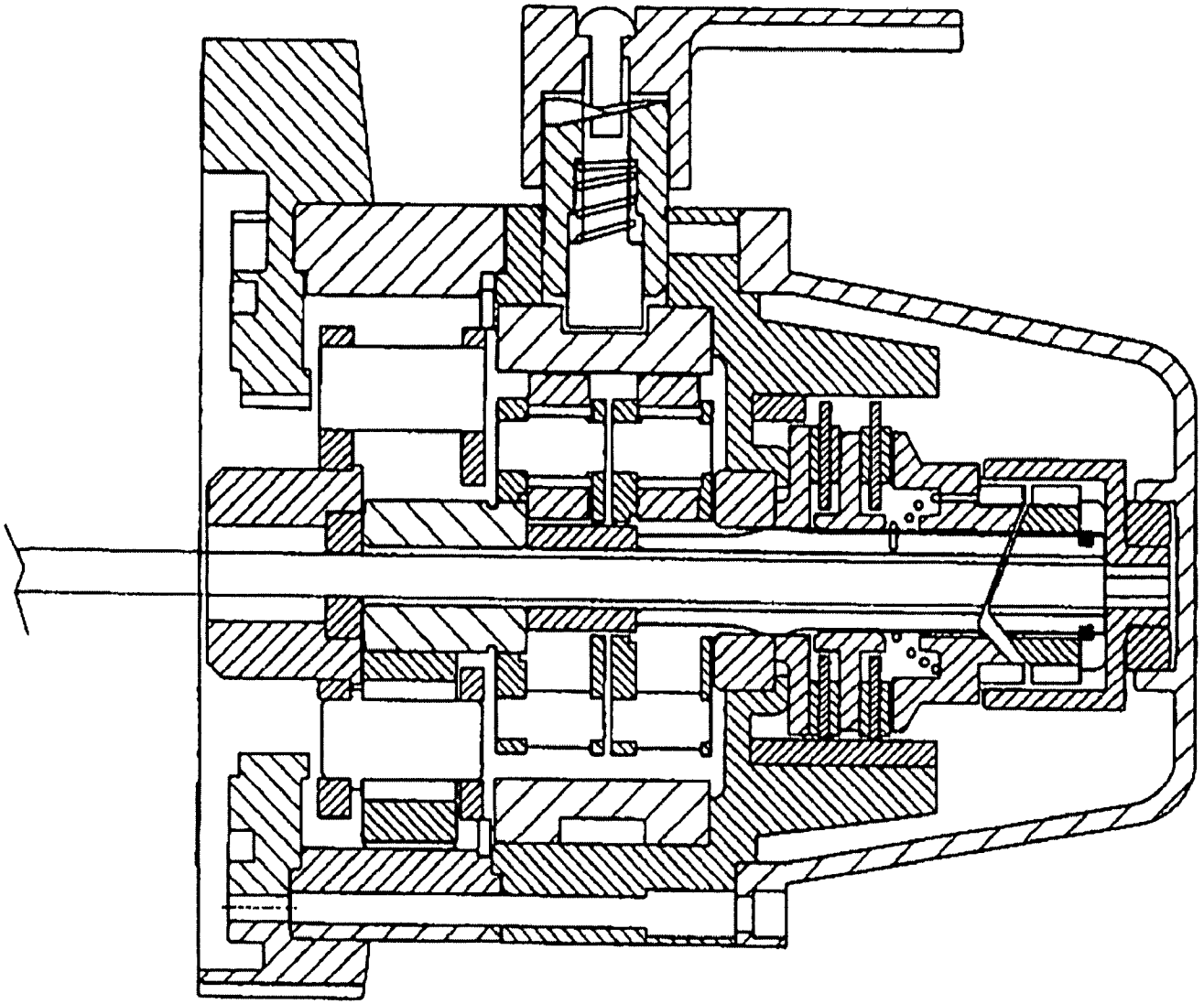
FIG. 9 is a schematic view showing relative positions of the present invention and a clutch device in an engaging state in an electric winch mechanism.
Figure 10:
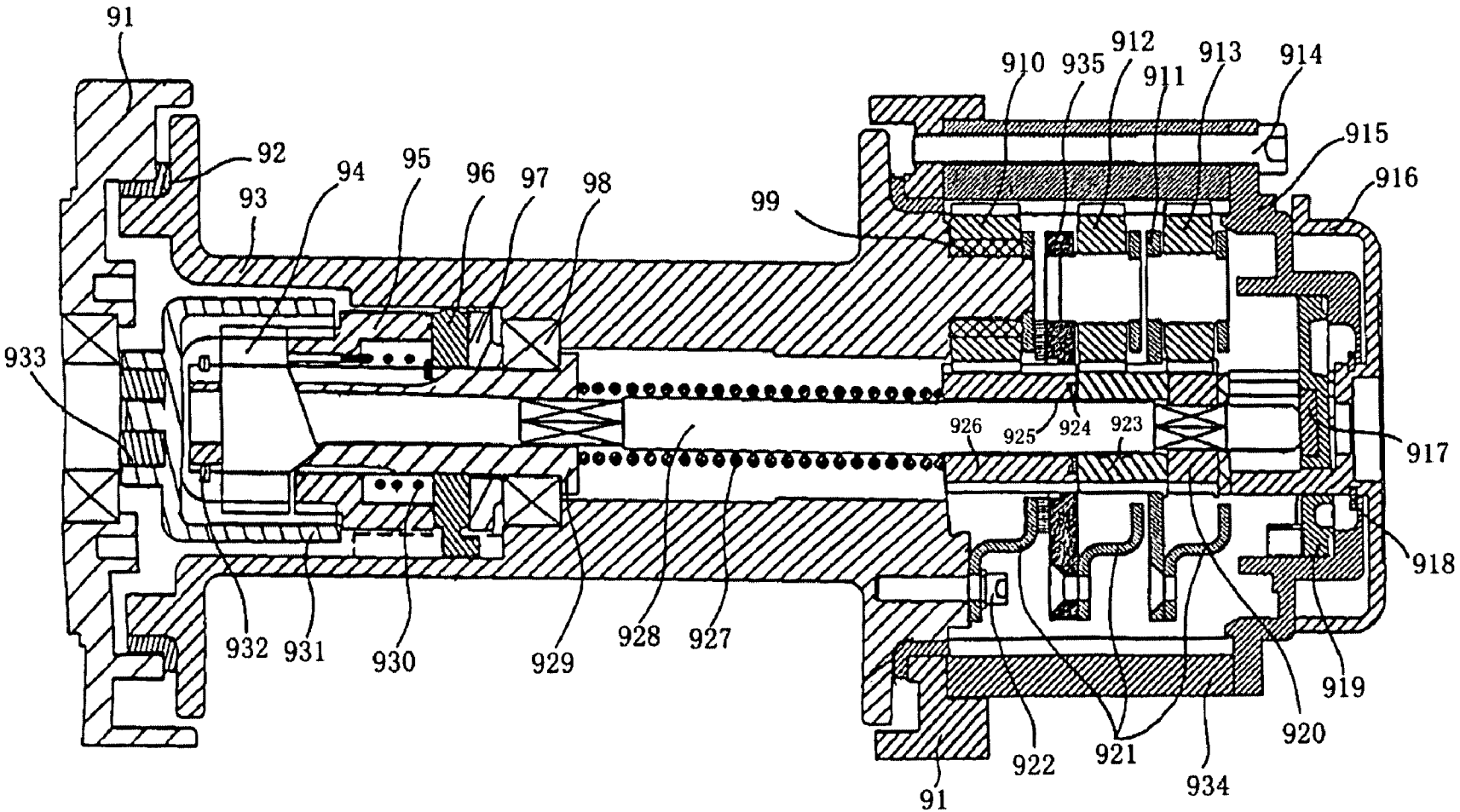
FIG. 10 is a cross-sectional view of an electric winch.
Figure 11:
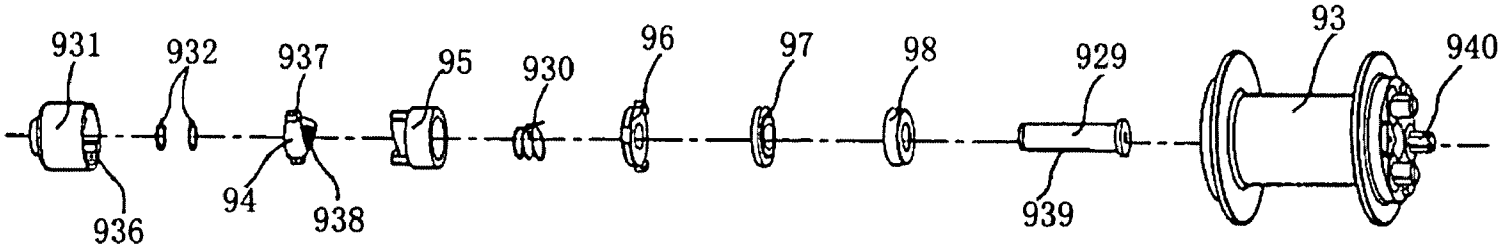
FIG. 11 is an exploded perspective view of a connecting shaft and parts disposed on the connecting shaft.

The section of hollow gear shaft 2 passes through a shaft hole of the wedge shape piece B 8, and there is no direct transmission relation between the wedge shape piece B 8 and the section of hollow gear shaft 2. An inner hole of the wedge shape piece A 9 is a splined gear hole which can engage with splined teeth of the section of hollow gear shaft 2 thereby forming a direct transmission relation therebetween, and at the same time, the wedge shape piece A 9 is axially limited by a group of C-shaped C-rings 10 which disposed on the hollow gear shaft 2 in order to limit and prevent the move of the wedge shape piece A. Combination end faces of the wedge shape piece B and the wedge shape piece A are cam faces 16 formed by double-inclined-faces. When the cam faces of the wedge shape piece B and the wedge shape piece A are combined with each other, the mechanism is in a non-braking state; and when the cam faces of the wedge shape piece B and the wedge block A, which are formed by double-inclined-faces, are detached from each other, the wedge shape piece A pushes the wedge shape piece B to move towards the left axially so that the mechanism is in a braking state where the mechanism abuts against the braking plates (as shown in FIGS. 6-8). Outer double flange structures 15, 14 are respectively arranged with homogeneous distribution on the outer surface along the circumferences of the wedge shape piece A and the wedge shape piece B on the outer circumference faces of the wedge shape piece A and the wedge shape piece B.

A braking clutch base 11 has a center shaft hole which is a hexahedral hole. The braking clutch base 11 sets on the hexahedron 18 of the end portion of the section of core shaft 1 and has a direct driving relation with the section of core shaft 1. The bearing 12 supports between the braking clutch base 11 and the braking cover 13. The braking clutch base 11 has an inner double flange structure 19 arranged with homogeneous distribution on the outer surface along the circumference thereof (as shown in FIG. 3, FIG. 5, FIG. 7, FIG. 8), matching to the outer double flange structures of the wedge shape piece A and the wedge shape piece B. When the section of core shaft 1 is driven by a motor shaft, the braking clutch base 11 rotates (clockwise or anticlockwise), and the inner double flanges 19 in the braking clutch base 11 push the outer double flanges 15 of the wedge shape piece A 9 so that the wedge shape piece A rotates along with the braking clutch base 11, thereby the section of hollow gear shaft can be driven to rotates synchronously by the wedge shape piece A. At the same time, the braking clutch base 11 immediately pushes the inner double flanges 19 to the outer double flanges 14 of the wedge shape piece B to drive the wedge shape piece B to rotate.

When a heavy load needs to be lifted, users can press a clockwise press button so that the motor core shaft rotates in clockwise direction. When the motor drives its core shaft to rotate, the braking clutch base is driven immediately and the inner double flanges in the braking clutch base are pushed to abut against the outer double flanges of the wedge shape piece A and the outer double flanges of the wedge shape piece B, so that the wedge shape pieces A, B can be synchronously driven to rotate (as shown in FIGS. 2-3). At this time, the wedge shape piece A drives the section of hollow gear shaft to rotate synchronously, so the section of hollow gear shaft engages with the above-mentioned deceleration gear group (not shown), thereby driving a tight wire drum to rotate to reel up a wire rope. Accordingly, the heavy load is lifted. At the same time, since the wedge shape piece B is also driven so that the angle difference between the wedge shape piece A and the wedge shape piece B disappears, the gentler cam inclined face of the wedge shape piece B is close to that of the wedge shape piece A (as shown in FIGS. 2-3), and the rotation force of the gentler cam inclined face is greater than a reverse twisting force on the wedge shape piece B, and besides, the reverse thrust force of the elastic element has an effect on the wedge shape piece B, the wedge shape piece B moves towards the right (as shown in FIG. 2 and FIG. 4). Accordingly, the braking plates are detached from the friction faces, and the heavy load can be lifted successfully. When the motor stops transferring power, the motor core shaft and the braking clutch base thereupon stop rotating, so the inner double flanges 19 in the braking clutch base 11 stop pushing the outer double flanges 14, 15. At this time, a twisting force produced under the gravity of the heavy load pulls the tight wire drum to turn back through the wire rope and is transmitted to the core shaft 1 and the wedge shape piece A via the deceleration gear group so that the core shaft 1 and the wedge shape piece A are desired to turn back. In fact, the wedge shape piece A really turns back for a very small distance and then stops. So the angle difference between the wedge shape piece B and the wedge shape piece A instantly appears, and the steeper inclined face of the wedge shape piece A is pushed to that of the wedge shape piece B, and besides, the reverse twisting force of the elastic element has the effect on the wedge shape piece B, the wedge shape piece B has to move towards the left (as shown in FIG. 7 and FIG. 8), thereby instantly producing a braking effect of contact friction of the braking plates and friction faces. Furthermore, the greater the twisting force of the heavy load is, the greater the push force that the wedge shape piece A exerts on the wedge shape piece B is, so the braking force produced by the contact friction is greater.

Figure 5:
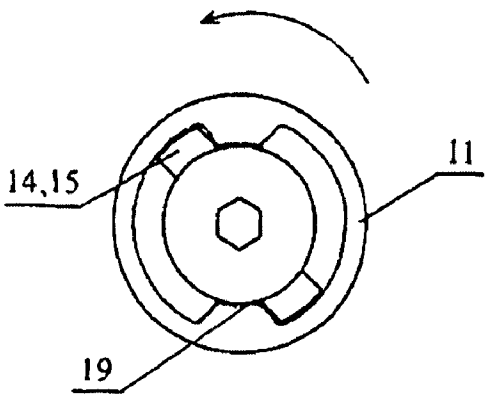
FIG. 5 is a schematic view showing relative positions of the braking clutch base and the wedge shape pieces A, B when the present invention is in the anticlockwise rotation and non-braking state.

The braking effect produced in the process of lifting the heavy load to a higher position is described above. In another process that the heavy load is lowered from a higher position to a lower position, when the heavy load has been lifted to the end of the wire rope and hung in the air, the braking effect, which is described above and produced when the power is off, as shown in FIG. 7 and FIG. 8, is firstly produced. Then users can operate the motor so that the motor rotates in anticlockwise direction, so the motor core shaft and the braking clutch base all rotate in anticlockwise direction. Instantly, the inner double flanges in the braking clutch base push the outer double flanges of the wedge shape piece B and the outer double flanges of the wedge shape piece A (as shown in FIGS. 4-5), so the angle difference between the wedge shape piece B and the wedge shape piece A disappears, and the gentler cam inclined face of the wedge shape piece B is close to that of the wedge shape piece A again (as shown in FIG. 4). Accordingly, the tapered face of the wedge shape piece B is detached from the friction faces of the braking plates, and the heavy load can be lowered successfully. Comparing FIG. 4 with FIG. 5, when the heavy load is lifted and lowered under power, the wedge shape piece B always moves towards the right slightly and stops braking. When the motor stops, the braking effect as shown in FIG. 8 is achieved quickly. Besides, there also exists the braking effect when the heavy load isn't lifted or lowered and the power is off.

Accordingly, the present invention has the braking effect after assembly. Once the motor works (in clockwise or anticlockwise direction), the braking effect disappears; and when the power is off or cut suddenly, the braking effect is instantly produced, and the heavier the heavy load is, the greater the braking force is, thereby ensuring safe and convenient use.

As shown in FIGS. 10-22, 91—support rack, 92—bushing, 93—drum, 94—wedge shape piece A, 95—wedge shape piece B, 96—braking plate, 97—stopping piece, 98—small bearing, 99—axle bushing, 910—third section planetary gears, 911—first grade transmission piece, 912—second section planetary gears, 913—first section planetary gears, 914—large inner hexagon screw, 915—clutch base, 916—handle, 917—friction block, 918—C-ring I, 919—rotation base, 920—first section shaft gear, 921—fixing piece, 922—small inner hexagonal screw, 923—second section shaft gear, 924—C-ring II, 925—copper washer, 926—third section shaft gear, 927—compression spring, 928—rotating shaft, 929—connecting shaft, 930—spiral spring, 931—braking base, 932—C-ring III, 933—motor shaft, 934—ring gear, 935—second grade transmission piece, 936—protruding strip, 937—protruding shoulder, 938—internal teeth, 939—external teeth, 940—gear shaft, 941—inserting feet, 942—protruding block, 943—protruding face, 944—blocking point.

An electric winch includes two left and right support racks 91, a drum 93 disposed between the two support racks 91 and having two ends supported by bushings, and a connecting shaft 929 disposed in the drum 93 and driven by a motor. The connecting shaft 929 is supported on a small bearing 98 and a braking device is disposed on the connecting shaft 929 to stop the connecting shaft 929 rotating. The braking device, as shown in FIG. 11 and FIGS. 13-20, includes a cylindrical braking base 931 connected with a motor shaft 933 via key and groove engagement transmission. Two symmetrical protruding strips 936 are disposed on the inner wall of the braking base 931. A wedge shape piece A 4 and a wedge shape piece B 5 are assembled in the braking base 931, engaging with each other based on cam faces. Two symmetrical protruding shoulders 937 are formed on the outer circumference face of the wedge shape piece A, and the wedge shape piece B 5 also has two symmetrical protruding shoulders 937 formed on the outer circumference face thereof. After the wedge shape piece B 5 and the wedge shape piece A 4 are assembled based on the cam face, the protruding shoulders of the two wedge shape pieces are just collinear. When the wedge shape piece B 5 and the wedge shape piece A 4 are assembled into the braking base 931, the protruding shoulders are driven by the protruding strips 936 of the braking base so that the wedge shape piece B 5 and the wedge shape piece A 4 rotate. The two wedge shape pieces also have inner hole structures, inner teeth formed on the inner hole wall of the wedge shape piece A 4. On one adjacent side of the wedge shape piece B 5, a braking plate 96 and a stopping piece 97, which are pushed to brake by a spiral spring 930, are disposed. The braking plate 96 and the stopping piece 97 are made of flexible materials in order to reduce mechanical wear of parts and improve braking stability during braking. The spiral spring 930 sets on the connecting shaft 929 and is disposed between the wedge shape piece B5 and the braking plate 96 on the connecting shaft 929. The connecting shaft 929 has external teeth 939 disposed on one end thereof, and the other end of the connecting shaft 929 has an inner hexagon structure. The end of the connecting shaft 929 with the external teeth 939 passes through the braking plate 96, the stopping piece 97, and the engaged wedge shape piece A 4 and wedge shape piece B 5 and then locks a pair of C-ring III 932. Also, the connecting shaft 929 is driven to rotate by the wedge shape piece A 4 via the engagement of the external teeth 939 and the internal teeth 938 of the wedge shape piece A 4.

Figure 12:
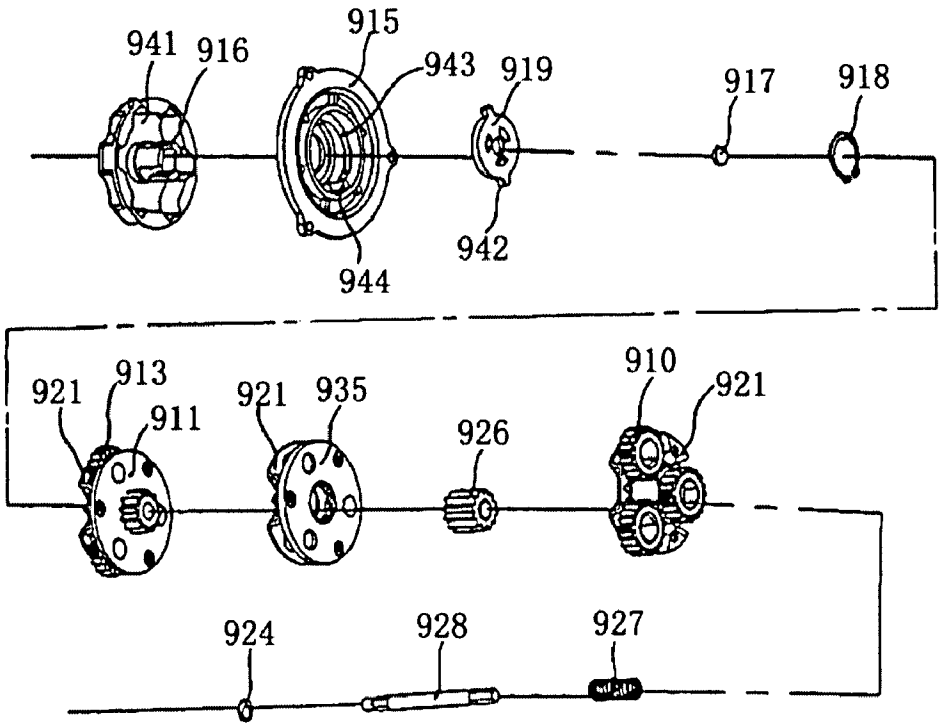
FIG. 12 is an exploded perspective view of a rotating shaft and parts disposed on the rotating shaft.

The connecting shaft 929 is drive-connected with the rotating shaft 928 based on the inner hexagon structure. The structures of parts disposed on the rotating shaft 928 are shown in FIG. 12. Third section shaft gear 926, second section shaft gear 923 and first section shaft teeth 920 are disposed on the rotating shaft 928, the first section shaft gear 920 drive-connected with the rotating shaft 928. A compression spring 927 sets on the rotating shaft 928, two ends of the compression spring 927 respectively abutting against the connecting shaft 929 and the third section shaft gear 926. The first section shaft gear 920 and the rotating shaft 928 establish a driving connection therebetween based on the inner hexagon structure. The first section shaft gear 920 also engage with first section planetary gears 913 and drive the first section planetary gears 913 to rotate. The first section planetary gears 913 are connected with the second section shaft gear 923 via first grade transmission pieces 911; correspondingly, the second section shaft gear 923 engage with second section planetary gears 912 which are connected with the third section shaft gear 926 via second grade transmission pieces 935, and the third section shaft gear 926 engage with third section planetary gears 910. The first grade transmission pieces 911 and the second grade transmission pieces 935 have a rotating shaft power transmission function. Each transmission piece has a fixing piece 921 fixed thereon, and the fixing pieces of the third second planetary gears 910 are fixed on the drum 93 via small inner hexagona screws 922. The third planetary gears 910 are further rotate three integral gear shafts 940 mounted on the end face of the drum 93. An axle bushing 99 for avoiding rotation wear is disposed between the third section planetary gears 910 and the integral gear shafts 940 of the drum 93, and the first section planetary gears 913, the second section planetary gears 912 and the third section planetary gears 910 engage with internal teeth of the ring gear 934 at the same time. When the rotating shaft 928 rotates in clockwise or anticlockwise direction to drive the three third section planetary gears 910 to rotate in the ring gear 934, the drum 93 can be drive to rotate in clockwise or anticlockwise direction.

Figure 21:
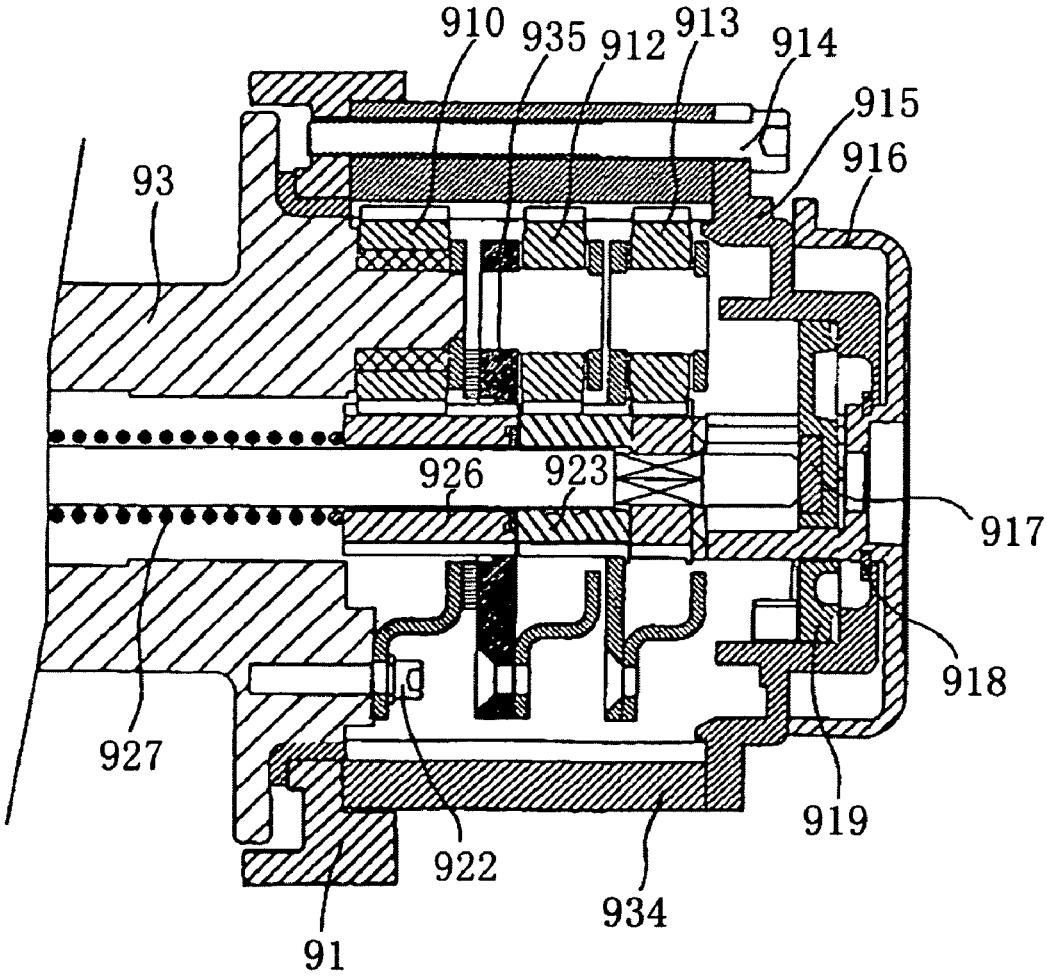
FIG. 21 is a structural view of a clutch in a non-on-off state.
Figure 22:
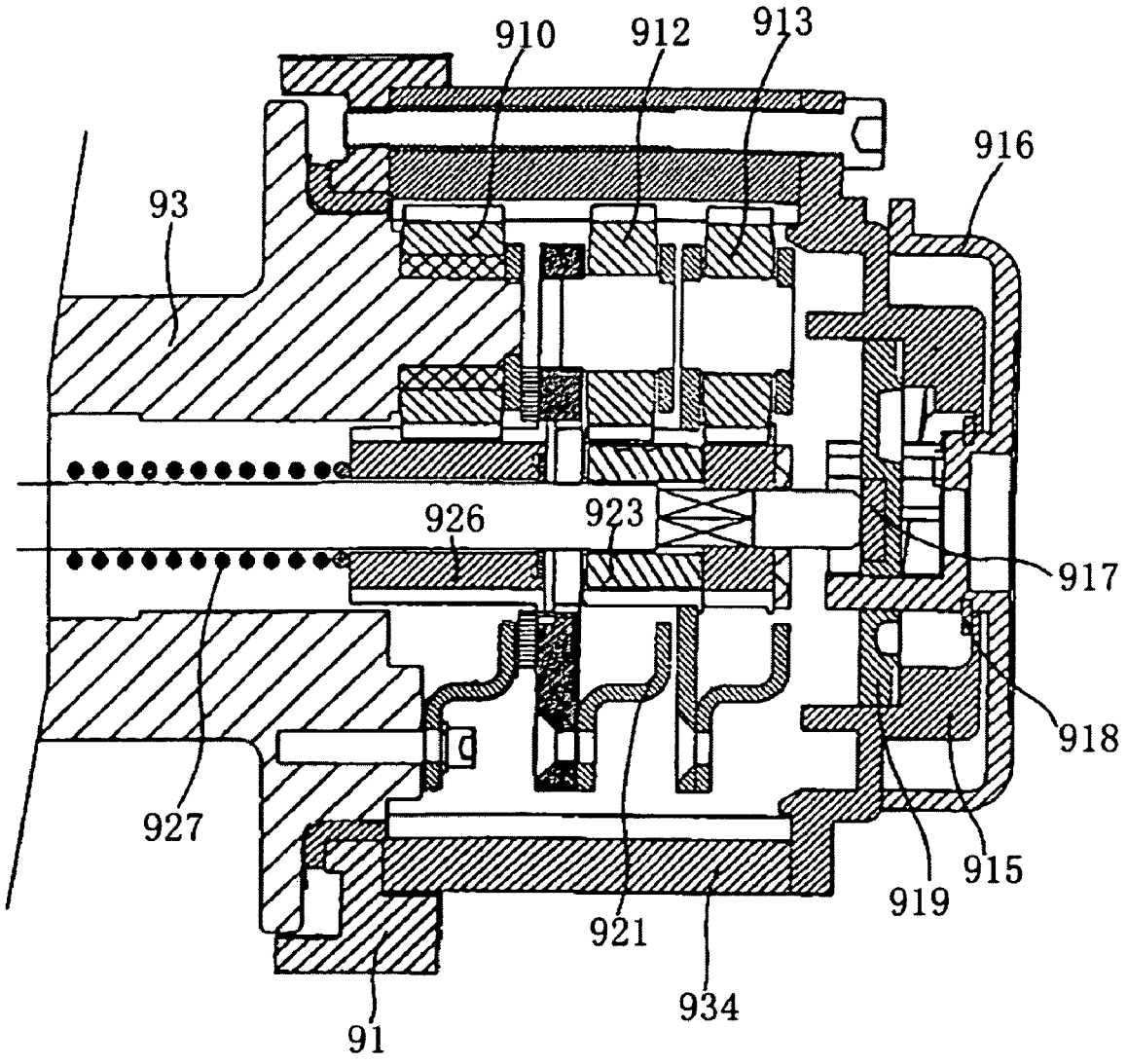
FIG. 22 is a structural view of the clutch in a on-off state.

A clutch device is disposed on the rotating shaft 928, a clutch shaft engaging with the drum 93. The clutch device, as shown in FIG. 21 and FIG. 22, includes a clutch base 915 fixed on support rack 91 via large inner hexagon screws. The bottom of the clutch base 915 is a rising and falling protruding face 943 which has blocking points 944 respectively disposed on the highest point and the lowest point of the protruding face 943. A clutch handle 916, which can rotate manually, is disposed on the clutch base 915. Three integral inserting feet 941 extend from the end face of the handle 916. The inserting feet have C-ring I 918 fastened thereon to prevent the handle 916 being detached from the clutch base 915. A rotation base 919 is disposed in the clutch base 915, abutting against the protruding face 943. The rotation base 919 is integrative with the integral inserting feet 941 of the handle 916 and driven to rotate by the integral inserting feet 941 of the handle 916. Two symmetrical protruding blocks 942 are disposed on the outer circumference face of the rotation base 919 and pushed by the protruding face 943 of the clutch base 915 and limited by the rotation of blocking points 944. The limitation way is that the protruding block just rises to the highest point of the whole protruding face 943 or falls to the lowest point of the whole protruding face 943 and is blocked to further rotate by the blocking points when the rotation base is driven by the handle 916 to rotate 150 degrees. A friction block 917 is disposed between the bottom of the rotation base 919 and the end portion of the rotating shaft 928 to reduce wear produced during relative rotation. Further, a C-ring II 924 and a copper washer 925 are fastened on the rotating shaft 928 between the second section shaft gear 923 and the third section shaft gear 926. The rotation base 919 pushes the rotating shaft and further pushes the third section shaft gear 926 which the compression spring 927 has an effect on to move and be detached from the second grade transmission pieces 935 via the fastened C-ring II 924, thereby clutching the engaged shaft gear and planetary gears and stopping the power transmission from the rotating shaft to the drum 93.

During use of the present invention, the motor starts, and the forward and the backward motor shafts 933 drive the braking base 931 to rotate. The braking base 931 drives the wedge shape piece A 4 and the wedge shape piece B 5 disposed in the braking base to rotate. The wedge shape piece A 4 drives the connecting shaft 929 to rotate via the internal teeth 938. The connecting shaft 929 drives the rotating shaft 928 and the first section shaft gear 920 on the rotating shaft 928 to rotate via the inner hexagon structure. At this time, after power enters the engaged first section shaft gear 920 and first section planetary gears 913, power is transferred to the engaged second section shaft gear 923 and second section planetary gears 912 through the first grade transmission pieces 911, and then transferred to the engaged third section shaft gear 926 and third section planetary gears 910 through the second grade transmission pieces 935. The third section planetary gears 910 rotate around the ring gear 934 under function of power, while they can drive the drum 93 to rotate in clockwise or anticlockwise direction, thereby pulling goods via reeling wire rope on the drum 93.

Figure 13:
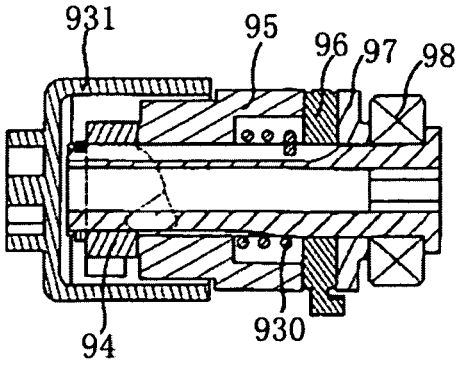
FIG. 13 is a braking structural view of the braking device.
Figure 14:
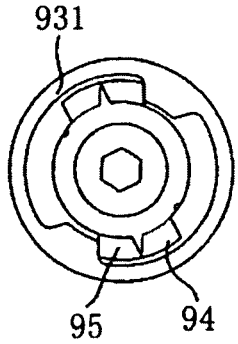
FIG. 14 is a schematic view showing relative positions of the wedge shape pieces A, B when the braking device is in a braking state.
Figure 15:
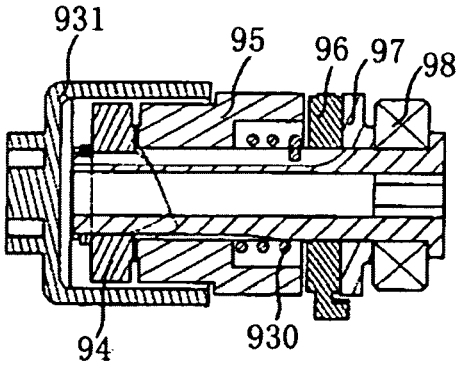
FIG. 15 is a structural view of the braking device when the connecting shaft rotates in anticlockwise direction.
Figure 16:
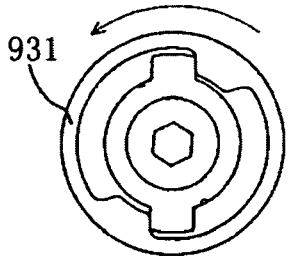
FIG. 16 is a schematic view showing positions of the wedge shape pieces A, B when the braking device runs in anticlockwise direction.
Figure 17:
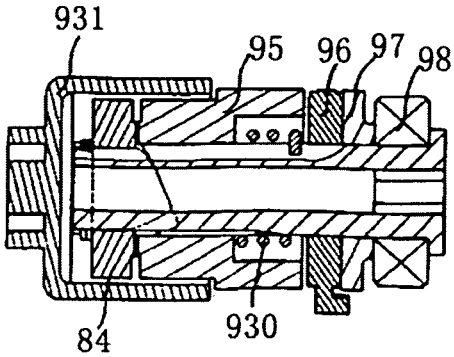
FIG. 17 is a structural view of the braking device when the connecting shaft rotates in clockwise direction.
Figure 18:
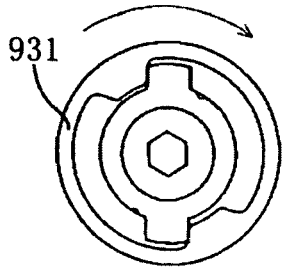
FIG. 18 is a schematic view showing positions of the wedge shape pieces A, B when the braking device runs in clockwise direction.
Figure 19:
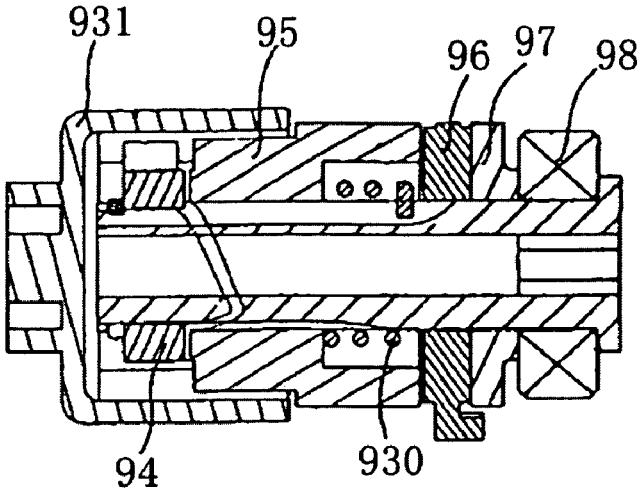
FIG. 19 is a structural view of the braking device, from a braking state to a running state.
Figure 20:
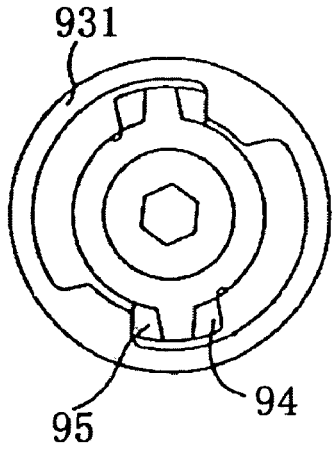
FIG. 20 is a schematic view showing positions of the wedge shape pieces A, B when the braking device is from the braking state to the running state.

During the work process of the braking device, as shown in FIGS. 13-20, after the motor turns off, the inertia causes that the rotating wedge shape piece A 4 and the rotating wedge shape piece B 5 have different rotating speeds, so that the cam face of the wedge shape piece A 4 is detached from the engagement position of the cam face of the wedge shape piece B 5, thereby pushing the wedge shape piece B 5 to press the braking plate 96 and the stopping piece 97. When the braking plate 96 and the stopping piece 97 are closest to each other, the connecting shaft 929, which can transfer power based on the engagement of the internal teeth and the external teeth, is locked, thereby achieving the braking effect. FIG. 13 and FIG. 14 are schematic views showing that the braking device is in the tightest braking state; FIG. 15 and FIG. 16 are schematic views showing positions of the wedge shape pieces A, B when the motor shaft rotates in anticlockwise direction; and FIG. 17 and FIG. 18 are schematic views showing positions of the wedge shape pieces A, B when the motor shaft rotates in clockwise direction. When restarting the motor, as shown in FIG. 19 and FIG. 20, the cam faces of the wedge shape piece A 4 and the wedge shape piece B 5 return to the assembled positions, and under the action of elasticity of the spiral spring 930, the plane of the wedge shape piece B 5 is pushed to be detached from the braking plate 96 and the stopping piece 97, so the drum 93 can rotate in clockwise and anticlockwise direction, without braking.

During the work process of the clutch device, as shown in FIGS. 21-20, the clutch handle 916 is turned in clockwise direction to drive the rotation base 919 to rotate under the action of the integral inserting feet 941 of the handle 916 and drive the rotation base 919 to move axially under the action of the rising and falling protruding face 943 of the bottom of the clutch base 915. When rotating to 150 degrees and limited by the blocking points 944, the two protruding blocks of the rotating base are located on the highest point of the protruding face, and at this time, the displacement is the maximum displacement; after the rotation base moving axially pushes the rotating shaft to move, the rotation base also pushes the third section shaft teeth to overcome the elasticity of the compression spring 927 and move via the C-ring II 924 and the copper washer 925 fastened on the rotating shaft, so that the third section shaft teeth are detached from the second grade transmission pieces 935 and the power transmission is interrupted, and then the drum 93 can be turned manually. When escaping from the on-off state, the clutch handle is turned in anticlockwise direction to 150 degrees and limited by the blocking points, and under the action of the elasticity of the compression spring 927, the third section shaft gear 926 reengage with the second grade transmission pieces 935 and the third section planetary gears 910, the second section planetary gears 912, and the first section planetary gears 913 return to the engagement positions, so the rotating shaft 928 transfers power to drive the drum 93 to rotate in clockwise and anticlockwise direction.

What is claimed is:

1. A plane braking device for an electric winch, comprising:

a gear box (4), fixed on the electric winch;

a braking cover (13), fixedly connected with the gear box;

a section of hollow gear shaft (2), inserted in a shaft hole of the gear box and supported by a bearing (3);

a section of core shaft (1), extending from a motor shaft and passing through the hollow gear shaft, wherein one extended end portion of the core shaft which extends out of the hollow gear shaft is a polyhedron;

a wedge shape piece A (9), setting on the hollow gear shaft (2) and engaging with the hollow gear shaft, wherein a left end face of the wedge shape piece A is a cam face (16) formed by double tapered faces, a right end face of the wedge shape piece A is limited axially by a C-ring (10), and an outer double flange (15) structure is arranged along an outer circumference surface of the wedge shape piece A;

a wedge shape piece B (8), setting on the hollow gear shaft (2), wherein a right end face of the wedge shape piece B is a cam face (16) formed by double tapered faces which engage with the wedge shape piece A, an outer double flange (15) structure is arranged on the outer surface along an outer circumference face of the wedge shape piece B;

a plurality of braking plates (6);

an elastic element (7), setting on the section of hollow gear shaft (2) and abutting against the wedge shape piece B (8);

a braking clutch base (11), having a center setting on the end portion of the section of core shaft (1) and combined with the polyhedron of the end portion, wherein a bearing (12) supported between the braking clutch base (11) and the braking cover (13), and an inner double flange (19) structure is formed on an inner circumference face of the braking clutch base (11), matching to the outer double flange structures of the wedge shape piece A and the wedge shape piece B, to push the outer double flange structure of the wedge shape piece A to rotate thereby pushing the wedge shape piece B to move axially;

wherein, a fixing ring (20), closely disposed on an inner shoulder of the gear box (4);

a wedge shape support (5), setting on the section of hollow gear shaft (2); and a plurality of stopping pieces (21), disposed between the wedge shape support (5) and the wedge shape piece B (8) and surrounding the section of hollow gear shaft (2) and engaged and drive-connected with the section of hollow gear shaft (2), the braking plates(6)limited radially to rotate by a plurality of fixing rings (20)and the elastic element(7)are disposed between the stopping pieces (21) and the wedge shape piece B.

2. The plane braking device for electric winches as claimed in claim 1, wherein a plurality of extending sections axially extends from one end face of the fixing ring (20) to form open slots arranged with homogeneous distribution on the outer surface along a circumference of the fixing ring (20), and the braking plate (6) has keys uniformly arranged on the outer surface on a circumference thereof and movably inserted in the open slots of the fixing ring (20).

3. The plane braking device for electric winches as claimed in claim wherein the number of braking plates (6) arranged axially is 4-6.

4. The plane braking device for electric winches as claimed in claim 1, wherein the wedge shape piece B (8) has a ring groove (17) formed in a left end face thereof for receiving the elastic element (7).

5. An electric winch, comprising:

left and right support racks (91);

a drum (93), disposed between the support racks and having two ends supported by bushings (92);

a connecting shaft (929), disposed in the drum (93) and driven to rotate by a motor;

a rotating shaft (928), drive-connected with the connecting shaft (929) and having a plurality of shaft gears each of which engages with corresponding planetary gears and drives the drum (93) to rotate in clockwise and anti-clockwise direction based on the rotation of the planetary gears in ring gear;

a braking device, disposed on the connecting shaft (929), a clutch device is disposed on the rotating shaft (928), wherein the braking device includes a braking base (931) which is drive connected with a motor shaft (933), wherein a wedge shape piece A (4) and a wedge shape piece B (95) are assembled in the braking base (931) and engaged on cam faces and driven to rotate by the braking base (931), internal teeth (938) of the wedge shape piece A engage with external teeth (939) of the connecting shaft (929), and on one adjacent side of the wedge shape piece B (95), a braking plate (96) and a stopping piece (97), which are pushed to brake by a spiral spring (930), are disposed, and the spiral spring (930) is disposed between the wedge shape piece B (95) and the braking plate (96) on the connecting shaft (929); and a clutch device, including a clutch base (915) fixed on the support racks (91), wherein a bottom of the clutch base (915) is a rising and falling protruding face (943) which has blocking points (944) disposed thereon; a clutch handle (916) is disposed on the clutch base (915), and integral inserting feet (941) extend from an end face of the handle (916); a rotation base (919) is disposed in the clutch base (915) and driven to rotate by the integral inserting feet (941) of the handle (916) two symmetrical protruding blocks (942) are disposed on an outer circumference face of the rotation base (919) and pushed by the protruding face (943) of the clutch base (915) and limited by the blocking points (944), and a C-ring II (924) and a copper washer (925) are disposed between adjacent ones of a plurality of shaft teeth on the rotating shaft (928) and fastened on the rotating shaft (928).

6. The electric winch as claimed in claim 5, wherein the plurality of shaft teeth are third section shaft gear (926), second section shaft gear (923) and first section shaft gear (92) drive-connected with the rotating shaft, which are setting on the rotating shaft (928), the corresponding first section shaft gear engage with first section planetary gears (913), the second section shaft gear engage with second section planetary gears (912), and the third section shaft gear engage with third section planetary gears (910); at the same time, first grade transmission pieces (911) are disposed between the first section planetary gears (913) and the second section shaft gear (923), and second grade transmission pieces (935) are disposed between the second section planetary gears (912) and the third section shaft gear (926); and the third section planetary gears (910) are setting on the drum (93).

7. The electric winch as claimed in claim 6, wherein an axle bushing (99) is disposed on an integral gear shafts (940) of the drum (93), between the third section planetary gears (910) and the drum (93).

8. The electric winch as claimed in claim 5, wherein a friction block (917) is disposed between a bottom of the rotation base (919) and an end portion of the rotating shaft (928).

* * * * *